US005564989A

United States Patent [19]

Larsen

[11] Patent Number: 5,564,989

[45] Date of Patent: Oct. 15, 1996

[54] GOLF SWING TRAINING DEVICE

[76] Inventor: Erling A. Larsen, 1501 N. Venice #L42, Tucson, Ariz. 85712

[21] Appl. No.: 522,141

[22] Filed: Aug. 31, 1995

[51] Int. Cl.[6] ..... A63B 69/36

[52] U.S. Cl. ..... 473/217; 473/269; 473/270; 36/43; 36/127; 273/DIG. 30

[58] Field of Search ..... 36/127, 43; 273/187.2, 273/188 A, DIG. 30; 473/217, 218, 270, 269

[56] References Cited

U.S. PATENT DOCUMENTS

| | | | |
|---|---|---|---|
| 2,847,769 | 8/1958 | Schlesinger | 36/127 |
| 4,106,771 | 8/1978 | Fern | 273/187.2 |
| 4,694,831 | 9/1987 | Seltzer | 36/43 X |
| 4,760,655 | 8/1988 | Mauch | 36/43 X |
| 5,212,894 | 5/1993 | Paparo | 36/127 X |
| 5,438,768 | 8/1995 | Bauerfeind | 36/43 X |
| 5,487,546 | 1/1996 | Yasuda | 473/217 |

*Primary Examiner*—George J. Marlo
*Attorney, Agent, or Firm*—Gregory J. Nelson

[57] ABSTRACT

A sports training device particularly intended for use by golfers to teach the proper body rotation and weight shift during a golf swing. The device includes a pair of shoe inserts each having a tactile indicating member arranged in the heel area disposed toward the inner side of the insert. The insert may be covered or partially covered by a textured material. The tactile member may be a series of projections on a ring or disk or may be other shapes and forms such as integrally molded spikes or concentric rings. The golfer will be provided a positive sense or feeling as weight is applied to the inserts.

11 Claims, 2 Drawing Sheets

GOLF SWING TRAINING DEVICE

FIELD OF THE INVENTION

The present invention relates to a training aid and more particularly relates to a sport training aid in the form of a pair of inserts to be placed in the footwear of the user in order to train the user in the proper body movement, particularly the proper weight shift during a golf swing.

BACKGROUND OF THE INVENTION

The golf swing appears deceptively simple but, in fact, is difficult to learn. The golfer begins in the address position with the shoulders positioned parallel to the target. Next, the golfer turns so that the shoulders assume a position perpendicular to the target line causing a coiling of the body which most golf instructors believe is the key to a powerful down swing. At the top of the back swing, the golfer's weight has shifted to the right side. The golf swing is completed by forward body rotation bringing the club head through the ball. In a correct swing, the golfer's weight will also shift to the forward foot.

Many training devices can be found in prior art to assist in teaching the proper golf swing and weight shift described above. For example, U.S. Pat. No. 2,847,769 discloses a golf shoe having a sole which has a wedge configuration which forces the player to assume the correct stance or position.

U.S. Pat. No. 3,951,407 shows a collapsible device which is attachable to the golfer's shoe to support the outside of the shoe in an elevated position with respect to the inside to aid in positioning the golfer in the proper stance.

U.S. Pat. No. 4,073,705 shows a golf training device also having a wedge-shaped member with pins which fit into holes provided on the sole of the golfer's shoe to attach the wedge to the shoe. The device of the '705 patent is somewhat similar to that shown in the '407 patent.

U.S. Pat. No. 4,106,771 discloses a device for indicating proper weight shift during a golf swing. The device is clamped to the instep of the golf shoe and has an extending spring which is deformed to produce an audible signal when predetermined flexure of the spring occurs.

U.S. Pat. No. 4,407,079 shows a golf aid attached to the outer edge of the sole of a golf shoe. The attachment has an arcuate surface which slopes toward the outside edge of the sole and upon which the golfer can pivot following impact and during follow through.

U.S. Pat. No. 4,953,311 shows an insert for a right handed golfer which goes into the right shoe and has maximum thickness in the rightward and rearward of the heel area. The left insert has maximum thickness in the rightward portion of the instep area. The canting and elevation provided by the device is stated to prevent reverse pivot and assists the golfer in that it produces a surface which the golfer may push against during a down swing.

U.S. Pat. No. 5,212,894 also shows an insole which is inserted in the golfer's shoe having both a front and rear portion so that each foot will respond properly during the swing. The insole of the golfer's front foot has a centerline thickness longitudinally to encourage a rolling action in the front foot while the rear foot insole includes a wedge-shaped member.

From the foregoing, it will be seen there are a number of patents that show golfing aids which attach exteriorly to the golf shoe. Some of these devices rely or impart a tactile sensation. Most are difficult to use or require special footwear. Accordingly, there exists a need for a simple and effective training device which can be conveniently used by golfers to teach the golfer the proper golf swing which is one in which the club head returns to its precise starting point in a stabilized circular motion.

SUMMARY OF THE INVENTION

Briefly, in accordance with the present invention, a sport training device is provided which consists of a pair of shoe inserts insertable into at least the heel area of the golfer's shoes. The bottom surface of each of the inserts has a frictional element such as a patch of material such as Velcro® material to prevent the insert from slipping with respect to the golf shoe insole. The upper surface of each of the inserts has a tactile indicating member positioned in the heel area and disposed toward the inner edge of the insert. When the inserts are used on the practice tee or as part of a daily practice regimen, the inserts serve as an infallible physical indicator that the golfer is rotating properly as opposed to a lateral or sliding body motion. Improper turning will result in mis-hits. The training device basically teaches muscle memory so that the user can program himself or herself to make a proper swing by sensing the pressure exerted by the heel of the foot against the tactile indicating members.

While the present invention is described primarily with respect to use as a golf training aid, the inserts can be used as shown or as modified within the scope of the invention for training in other areas such as training skiers in proper weighting and unweighting techniques and to assist golfers, particularly elderly golfers in maintaining balance.

The above and other objects and advantages the present invention will be more fully appreciated and understood from the following description, claims and drawings in which:

DETAILED DESCRIPTION OF THE DRAWINGS

At the outset, a brief discussion of the nature of the mechanics of a proper golf swing is helpful to an understanding of the invention. The following description is with respect to a right-handed golfer.

Figure 9:
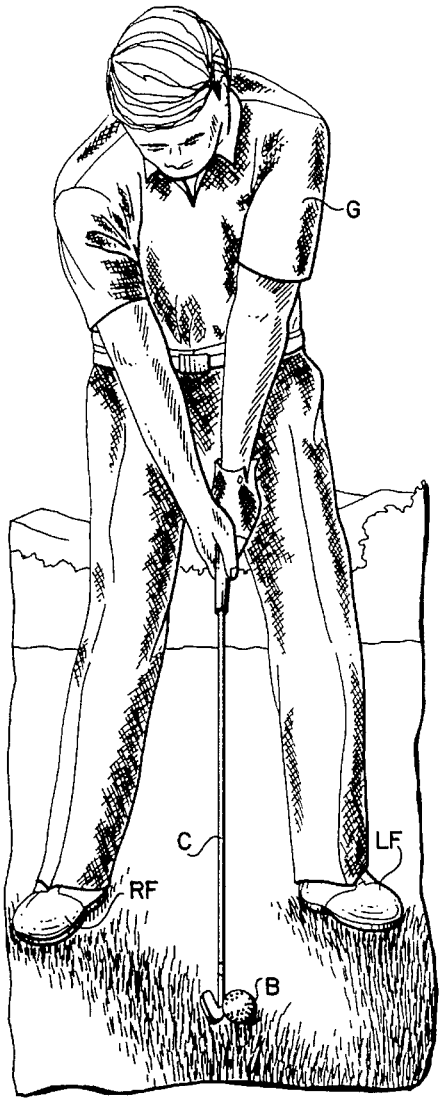
FIG. 9 is a front view of a golfer in the address position illustrating use of the golf training aid.
Figure 10:
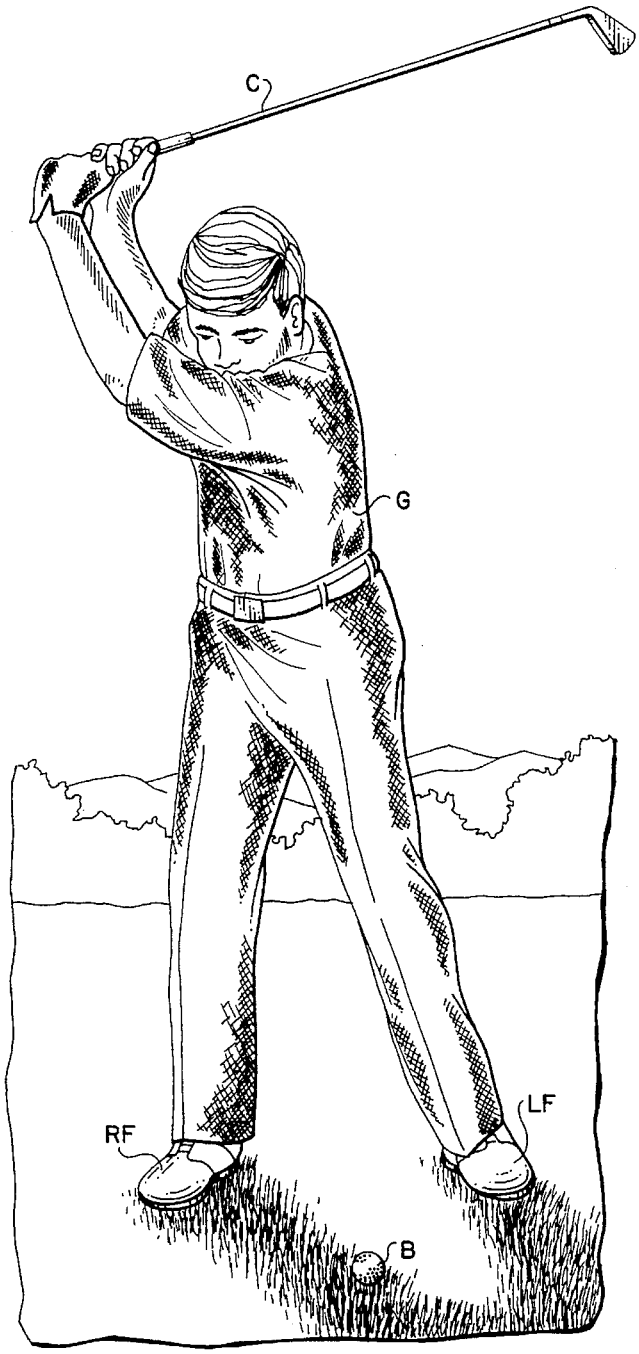
FIG. 10 is a front view of the golfer showing the golfer at the position at the top of the back swing in which in the proper swing has caused the weight to shift to the golfer's right foot.

The proper way to return a golf club head to its precise starting point and to strike the ball efficiently is to turn the upper body in a stabilized, rotary manner. The proper golf swing basically consists of two body turns. Normally, the golfer begins in the address position as shown in FIG. 9. The golfer is indicated by the letter "G" and is holding the golf club "C" in the proper position behind the ball "B". The golfer's weight should be generally evenly distributed on the golfer's left foot (LF) and right foot (RF) with the feet being apart the distance approximately corresponding to the width of the golfer's shoulders. The golfer initiates the golf swing with a slight forward press, that is, a forward movement of the hands from which the golfer will then begin the back swing, or inner turn (IT), which will bring the golfer "G" and the club "C" to the position shown in FIG. 10. The back swing is a circular or rotational movement bringing the golfer's shoulders to a position generally perpendicular to the target line. At the top, the golf club is in a position which is generally horizontal and the golfers left knee has flexed inwardly and the left heel may be slightly raised. At the position shown in FIG. 10, the golfer's weight has shifted with about 80% of the weight being on the golfer's right foot RF. The right leg serves to provide stability while the golfer coils into a powerful position. If the back swing is proper, the golfer's weight should be concentrated on the inner side of the right foot which makes it possible for the golfer to maintain a stable and stationary position over the ball with the head remaining behind the ball through impact.

Assuming the classic Vardon golf grip, and with the stance and posture as shown in FIG. 9, about 60% of body weight is on the left heel pad as the back swing or inward turn is initiated. This initial movement pushes the club head rearwardly and upwardly in a vertical arc just behind and above the right ear.

The extent of the back swing or IT varies according to the flexibility of the individual. As indicated, a 90° turn will place the left shoulder right under the chin and generates a down-in press on the ball of the left foot indicating that the hips as well as the shoulders have turned clockwise. The left heel comes off the ground one to two inches and a delayed wrist cock positions the shaft parallel or approximately horizontal with respect to the ground. A more vertical back swing places the hands under the shaft with the club head pointed directly at the target in a manner similar to aiming a rifle.

When a smooth reversal of the left hip on a solid left heel pad initiates the down swing or outer turn (OT), the arc of the club head is directed downwardly, not forwardly, as in a right side push. The initial movement should not be forced but should allow the hands to move freely downwardly. The left hip remains unblocked and both arms descend close to the body. The hands release and the thrust to the right side is delayed as long as possible. After impact occurs, both arms fully extend and pronate or roll over. The head remains generally stationary behind the ball. In the finish position, the golfer's belt buckle should finish facing the target. Even though the left arm bends slightly during the turn, the arm will always straighten to its longest natural length for consistent arc through the ball provided the left hip initiates the turn and the head remains in generally a stationary position. At the point of impact, the golfer's weight has moved from the right foot to the left foot and as the outer turn continues, the golfer's weight will tend to move forwardly completing a follow-through which positions the golfer facing the target.

The acid test of a proper swing is sometimes identified by the acronym FIBD which means "first in both directions". If the body moves properly, the arms are not simply swinging but the golfer has asserted the left side creating momentum. In a proper swing, the body leads and the arms accelerate through the ball with the club creating a full arc behind the head with the golfer completing the swing facing the target. If the proper weight shift does not occur, the arm decelerates and there is no follow through.

It will be apparent that the description above is with respect to the movements performed by a right-handed golfer. The basic description above also applies to a left-handed golfer but it will be apparent that references with respect to the golfer's right and left are reversed.

The present invention provides the golfer a physical indication that the proper circular body motion and weight shift FIBD occurs. The present invention is a pair of inserts with one being worn in each of the golf shoes. The inserts serve to apply a tactile sensation to the inside of each heel to physically remind the golfer that the proper weight shift or rotation is occurring. By providing a physical reminder or tactile sensation, the golfer is taught the proper swing and muscle memory is reinforced.

The preferred form of the training device of the present invention is shown in FIGS. 1 to 4 and is generally designated by the numeral 10. The device 10 is one insert of a pair that is provided. Both are constructed in the same manner and are different only in that one is the mirror image of the other. The insert 10 is for the right shoe having a base 12 and has outer side 14 and inner side 16, curved heel portion 15, and arcuate front edge 18. The insert is generally configured to correspond in shape to the heel area of footwear such as a golf shoe and may be provided in various sizes to correspond to various size golf shoes. While the insert 10 shown corresponds in shape to the heel area of the shoe, the base 12 may also be part of a more complete insole insertable in footwear. The base 12 may be made of a suitable flexible and supple material such as leather, rubber such as neoprene or silicon rubber, plastic such as urethane, or a composite of any of these materials.

Figure 1:
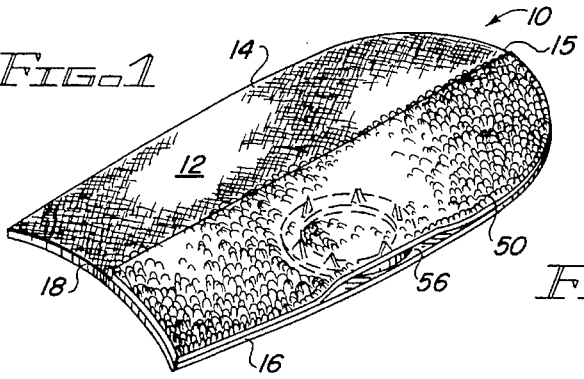
FIG. 1 is a perspective view showing the upper surface of a shoe insert according to the present invention for use in the right shoe.
Figure 2:
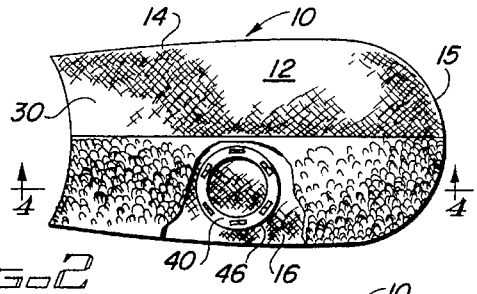
FIG. 2 is a plan view of the shoe insert of FIG. 1 partly broken away to better illustrate the tactile indicating member.
Figure 3:
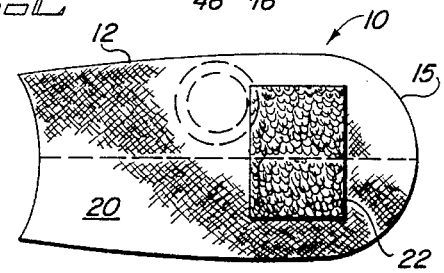
FIG. 3 is a bottom view of the shoe insert of FIG. 1 showing the frictional retaining element.
Figure 4:
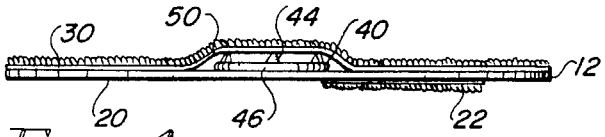
FIG. 4 is a sectional view taken along line 4—4 of FIG. 2.

As seen in FIG. 3, the base has planar bottom surface 20 which is provided with a frictional retaining element 22 at a central location adjacent the curved heel portion 15. The fictional element 22 prevents the insert from slipping relative to the shoe insole when in use. As shown, the frictional retaining element 22 consists of generally rectangular patch of either the loop or hook portion of a fabric fastener such as fabric fasteners sold under the trademark "Velcro"®. The patch may be stitched or adhesively secured to the bottom 20 of the base 12.

Figure 5:
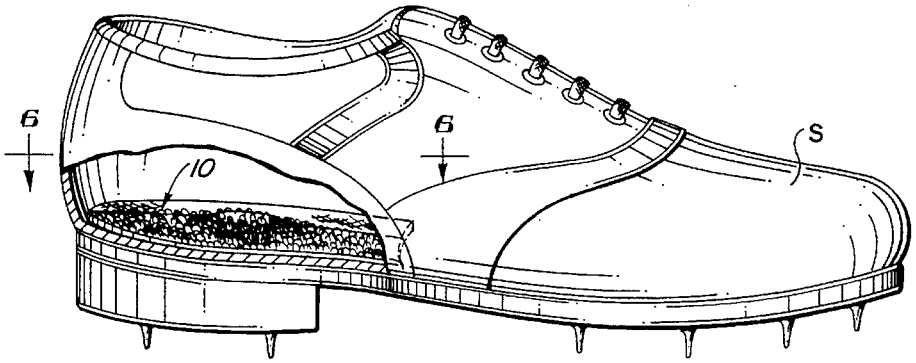
FIG. 5 is a side view of a left golf shoe partly broke away showing an insert in position in the heel area of the shoe.
Figure 6:
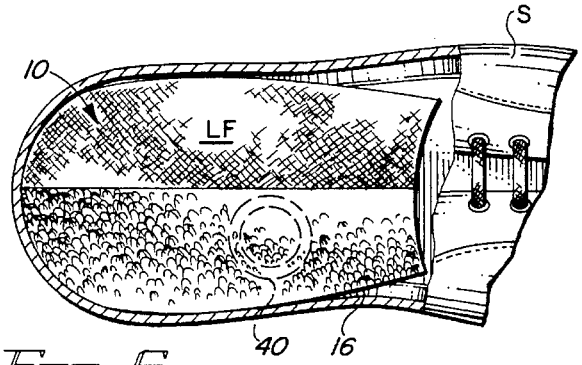
FIG. 6 is a top view of the shoe shown in FIG. 5 also partly broken away to illustrate an insert in position in a golf shoe.

The upper surface 30 of the base has a tactile indicating member 40 which is attached to the upper surface of the base at a location disposed toward the inner side 16 of the insert. The insert shown in FIGS. 1 to 4 is intended to be worn in the right shoe. FIGS. 5 and 6, as will be explained hereafter, illustrate the form of the insert applied to the left shoe which is a mirror image of the right foot version of the device. For this reason, the details of construction are set forth with respect to the right foot version and it is believed that it would be unnecessarily repetitive to repeat this description with respect to the left shoe version, it being understood that it is a mirror image of the right foot version.

Tactile indicating element 40 provides the wearer a pronounced physical indication of the degree of pressure being applied by the user's foot in the area of the tactile member. Accordingly, the tactile indicating member includes a plurality of upward projection prongs 44 disposed about the periphery of disk or ring 46. The tactile member may be made of any suitable material such as plastic or, in the case shown, formed of a suitable metal material such as plated sheet metal. The projections have sufficient strength and rigidity so as not to be flattened or bent over time as use occurs. Typically, the tactile member will be circular having a diameter of approximately 1". The tactile member is held in place and the sensation imparted by the tactile element modified somewhat by a cover 50 of a roughly textured material. The cover 50 is shown as a section of one portion of the loop and hook fabric fastener material such Velcro material. The covering extends over the upper surface 30 of the insert from a location approximately from the longitudinal centerline of the insert to the inner side 16. The covering 50 may be adhesively joined to the upper surface of the base except in the area 55 forming a pocket 56 at the inner side into which the tactile member 40 may be inserted.

FIGS. 5 and 6 illustrate the use of the positioning of the insert in a left golf shoe "S" and carries the marking or indicia "LF". The golf shoe is a conventional golf shoe having an upper area and a sole carrying a plurality of spikes. The insert is positioned in the heel section of the golf shoe with the tactile member 40 disposed toward the inner side 16 of the insert and the golf shoe once inserted.

In use, golfer will place an insert in each shoe of a pair of golf shoes with the tactile members positioned toward the inner edge of the shoe. As mentioned above, the invention has been described as an insert conforming to the shape of the rear portion of the sole but could also be part of a complete insole.

As the golfer swings, beginning at the proper address position, the tactile members 40 associated with each shoe insert will transmit a sensation to the golfer's feet indicating the presence of pressure and also the degree of pressure. The golfer should feel the sensation of pressure at the beginning of the swing or address where it should be felt in the heel area of both feet. As the back swing begins, the golfer's weight shifts to the inner side of the right foot and heel followed by the outer turn of the body. As the downswing begins, a pronounced weight shift occurs which, if properly done, will be sensed or felt by the golfer in the left heel area which is followed by the inner turn of the body. If the proper sensation is not transmitted to the golfer's feet, the golfer will know to make the necessary corrections. Once learned, the routine can be practiced and reinforced.

Figure 8:
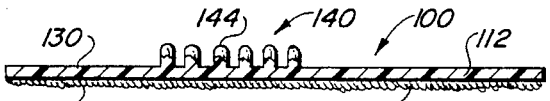
FIG. 8 is a sectional view taken along 8—8 of FIG. 7.
Figure 7:
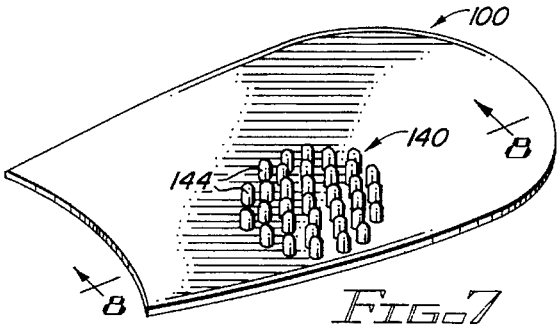
FIG. 7 is a perspective view of an alternate embodiment of a shoe insert according to the present invention.

FIGS. 7 and 8 illustrate an alternate embodiment of the present invention generally designated by the numeral 100. The training device as shown in FIGS. 7 and 8, has a base 112 of suitable, flexible material which may be a molded rubber or a plastic such as urethane having a general configuration conforming to the rear portion of a shoe insole or may be a complete shoe insole. The insert 100 has an upper surface 130 and a lower surface 120. The lower surface is provided with a frictional element 122 which can be adhesively or otherwise secured to the surface. The frictional element may be a section or portion of loop and hook fastener material which will assist in preventing the insert from slipping with respect to the shoe.

Tactile element 140 is integrally molded as part of the base 112 and consists of a plurality of upwardly extending projections 144 integrally formed with the base. The projections should be sufficiently rigid to transmit a clearly identifiable sensation to the foot of the user.

Figure 11:
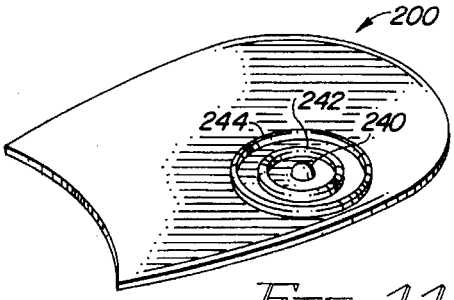
FIG. 11 shows still another embodiment of the shoe insert of the present invention.

It is obvious that other projection shapes could be integrally molded into the surface of the insole so as to provide the same result. For example, insert 200 can be provided the tactile member in the form of a series of concentric annular rings 240, 242, 244 arranged to form the tactile indicators on base 212 as shown in FIG. 11.

From the foregoing it will be seen the present invention provides an effective yet simple training device which may be used by golfers and others who are attempting to train their muscles to accomplish a particular body movement. The device the present invention can be easily manufactured from a variety of materials and may be used both by the amateur and professional athlete.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A sports training device to be worn on the insole of the shoe of a user, said device comprising:

(a) an insert having a generally planar body having a top surface, a bottom surface and an inner and outer edge and having a shape generally conforming to at least the heel area of the shoe insole and insertable in the heel area of the shoe; and (b) tactile indicating means associated with said top surface and disposed only in the area proximate the inner edge of the insert and projecting upwardly from said top surface, whereby when the device is worn an the insole of the shoe of a user a physical indication of pressure applied to the tactile indicating means will be transmitted only to the inner side of the user's heel to encourage proper body rotation.

2. The sports training device of claim 1 wherein said insert is fabricated of a flexible material.

3. The sports training device of claim 2 wherein said flexible material is leather.

4. The sports training device of claim 2 wherein said flexible material is an elastomeric material.

5. The sports training device of claim 1 wherein said bottom surface is provided with frictional engaging means for preventing slipping of the device relative to the shoe insole.

6. The sports training device of claim 1 wherein said tactile indicating means comprises a plurality of upwardly extending projections.

7. The sports training device of claim 6 wherein a fabric covering extends over said upwardly extending projections.

8. The sports training device of claim 7 wherein said fabric covering comprises a section of loop and hook fabric fastener material.

9. The sports training device of claim 1 wherein said tactile indicating means comprises a disk having a plurality of projections extending upwardly therefrom.

10. The sports training device of claim 1 wherein said tactile indicating means comprises a plurahty of generally concentric rings.

11. The sports training device of claim 1 wherein said tactile indicating means comprises a plurality of projections integrally formed on said insert.

* * * * *